United States Patent [19]

Cartwright

[11] Patent Number: 5,055,988

[45] Date of Patent: Oct. 8, 1991

[54] SURGERY LAMP WITH VENTILATION FOR COOLING

[75] Inventor: Richard N. Cartwright, Independence, Mo.

[73] Assignee: Schroer Manufacturing Company, Kansas City, Mo.

[21] Appl. No.: 487,664

[22] Filed: Mar. 2, 1990

[51] Int. Cl.[5] ..... F21V 29/00

[52] U.S. Cl. ..... 362/294; 362/240; 362/250; 362/293; 362/373; 362/287; 362/804

[58] Field of Search ..... 362/263, 240, 249, 250, 362/269, 285, 287, 293, 294, 370, 371, 373, 804, 399

[56] References Cited

U.S. PATENT DOCUMENTS

| | | | |
|---|---|---|---|
| 3,588,488 | 6/1971 | Lauterbach | 362/804 |
| 4,032,771 | 6/1977 | Ilzig | 362/804 |
| 4,037,096 | 7/1977 | Brendgord et al. | 362/804 |
| 4,254,454 | 3/1981 | Hardin, Jr. | 362/282 |
| 4,316,237 | 2/1982 | Yamada et al. | 362/250 X |
| 4,600,979 | 7/1986 | Fisher et al. | 362/294 |
| 4,617,619 | 10/1986 | Gehly | 362/294 X |
| 4,745,526 | 5/1988 | Sestak | 362/250 X |
| 4,803,607 | 2/1989 | Jönssen | 362/240 X |
| 4,916,597 | 4/1990 | Hallings et al. | 362/804 X |

FOREIGN PATENT DOCUMENTS

| | | | |
|---|---|---|---|
| 531345 | 4/1932 | Fed. Rep. of Germany | 362/373 |

*Primary Examiner*—Stephen F. Husar
*Attorney, Agent, or Firm*—Wm. Bruce Day

[57] ABSTRACT

A surgical lamp having four quartz-halogen lamps and color-correcting glass filters that also shield the light bulbs provides flat shadow-free intense lighting having a color temperature of at least about 3,500° K. for surgical purposes and includes a shroud having lower ventilating openings, interior baffles for directing the flow of warm air along a plurality of chimneys, and a plurality of ventilating holes in the top of the shroud. The surgical lamp may also include a floor stand or ceiling mount, and includes an arm having a number of pivot points that allow the surgeon to adjust the position of the light by grasping the handle and moving the light to the desired location.

24 Claims, 3 Drawing Sheets

SURGERY LAMP WITH VENTILATION FOR COOLING

BACKGROUND OF THE INVENTION

1. Field of the Invention

This invention relates to lamps utilizing light bulbs. More particularly, this invention relates to lamps for surgery having convection-induced ventilation for cooling.

2. Related Art

Many surgical lighting fixtures have been developed to provide high intensity light having a high color temperature that reduce the heat radiated toward the patient. Excess heat dries tissues during surgery. Color temperatures less than about 3,500° K. distort colors that a surgeon frequently relies on to diagnose disease and the patient's condition, making color-corrected lighting important.

One effort to develop such a lamp is disclosed in U.S. Pat. No. 4,032,771, issued to Ilzig on June 28, 1977, which discloses a surgical operating lamp with mainly cold light radiation which results from the reflection of the infrared portion of the light spectrum emanating from a light source through a concave cold light reflector that reflects the infrared toward a heat absorbing body surrounding the lamp body. An outer bell surrounds the heat absorbing body and the passageway formed between the outer bell and the heat absorbing body conducts the heated air to a vent outlet, thereby cooling the lamp.

Another such development is disclosed in U.S. Pat. No. 3,588,488 issued to Lauterbach on June 28, 1971, which discloses a surgical light fixture having a high Kelvin rating of approximately 6,000° K., which is attained by raising the color temperature of the illumination source from 3,000° K. to 6,000° K. This increase is attained by employing an internal cylindrical filter and a dichroic reflector surrounding the internal filter.

The systems such as those disclosed in the Ilzig and the Lauterbach patents are expensive to manufacture. They are, in fact, too expensive for many potential applications such as animal surgery.

Accordingly, there is a need for a relatively inexpensive color corrected surgery light that provides high intensity shadow-free illumination for use by veterinarians or others during surgery.

SUMMARY OF THE INVENTION

It is, therefore, the primary object of the present invention to provide a relatively inexpensive color corrected surgery light that provides high intensity shadow-free illumination for use by veterinarians or others during surgery.

These and other objects of the present invention are achieved by providing a surgery lamp comprising a base, a stand attached to the base, and a lighthead which includes a plurality of individual light bulbs, that is attached to the stand. The lighthead may be mounted on a wall, may depend from the ceiling, or may be floor mounted on a base set on the floor, which supports the stand. In this later case, the stand is tall enough that the lighthead is suspended over the surgeon's work area. The lamp may also include emergency electrical supply that automatically engages during any power failure or significant fluctuation in the standard line voltage or cycles per second available to the lamp.

The lamp also includes means for conducting electricity to the individual light bulbs and means for adjustably attaching the lighthead to the stand so that the position of the lighthead can be readily adjusted during surgery. For this purpose, a handle typically projects downwardly from the center of the lighthead. The lamp further includes means for ventilating the lighthead to induce the escape of excess heat, preventing the heat of the lamps from being radiated onto the patient and from building up within the lighthead, which would overheat the light bulbs, causing them to fail prematurely.

The lighthead further comprises a support bar for attaching the lighthead to the stand and for supporting the lighthead. The support bar is attached to a frame or chassis, and may penetrate the chassis. The support bar and chassis bear the weight of the lighthead and support it when it is attached to the stand.

A plurality of baffles is attached to the top of the frame or chassis and extend outwardly therefrom and essentially slope downward somewhat from the horizontal when the lighthead is projecting light directly downward. In a preferred embodiment, there are four baffles, one for each of the four light bulbs. In a plan view, the four baffles are disposed in a pattern having the shape of a cross with perpendicular arms and a plurality of holes for attachment to the chassis and attachment of the shroud distributed in and around the central portion of the cross pattern. That is, the baffles are laid out at 90° from one another. The baffles further comprise an outer flange portion that is disposed or bent at a downward angle relative to the horizontal whereby the baffles deflect rising heated air, which flows along the underside of the baffle and through the holes. The baffles may also have an intermediate portion between the outer portion and the central portion of the cross pattern which is disposed downward at a slight angle relative to the central portion of the cross pattern to further encourage the heated air to flow upwardly along the baffles.

The lamp head further comprises a shroud having an upper body and a lower body that are fastened together and which enclose the frame or chassis, the baffles, the brackets, and the light bulbs. In the preferred embodiment, the shroud is circular. The shroud includes means for dissipating heat. The heat dissipating means may include a large circular opening at the top of the upper body of the shroud into which is fastened a disk having a plurality of holes therein for ventilating hot air heated by the light bulbs. Alternatively, the upper body of the shroud may itself include a plurality of ventilating holes. The lower body of the shroud includes an opening for each of the light bulbs, which is four in the preferred embodiment. The diameter of the opening is slightly larger than the diameter of the lens portion of the light bulb, which allows air to enter the space between the light bulb and the lower body of the shroud for cooling and ventilation. Each opening include a smooth circular up-turned lip that flows into the lighthead to direct and facilitate the flow of cooling air into the lighthead.

The lamp further comprises a glass hold-down bracket disposed below each light bulb. A light filter, preferably glass, for correcting the color temperature is situated within each glass hold-down bracket. The lighthead also includes a depending handle attached to a lower portion of the lighthead, preferably in the center of the light pattern and fastened to the chassis or to the lower body of the shroud.

The light bulbs are preferably quarts-halogen spot lights with self-contained dichroic reflectors and a projected light beam pattern of 12°. The use of such bulbs allows the development of a relatively inexpensive surgery lamp.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

As required by the case law and the statutes, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 5:
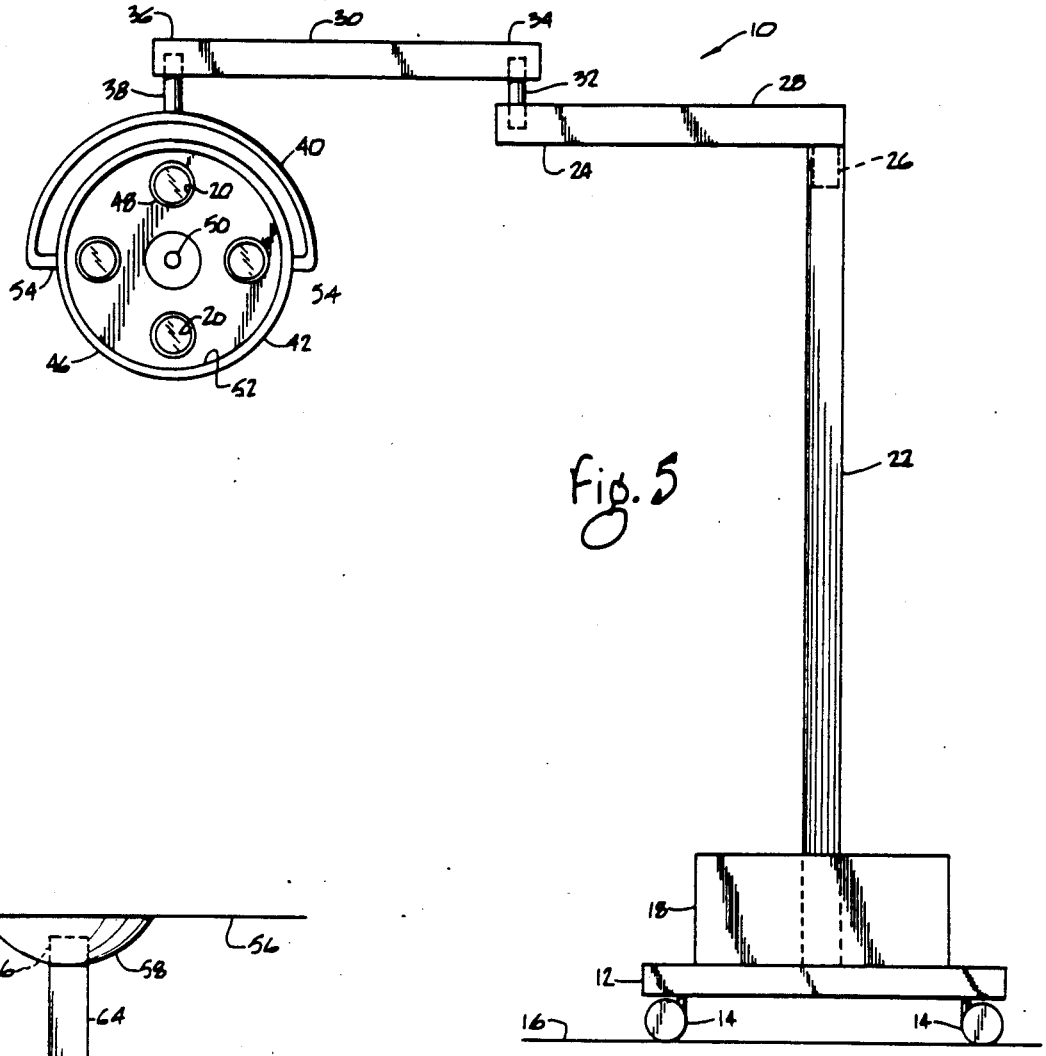
FIG. 5 is a simplified side elevation of a lamp according to the present invention.

Referring to FIG. 5, there is shown the surgical lamp 10 comprising a base 12 having wheels or casters 14, which allow the surgical lamp 10 to be rolled across the floor 16. The base 12 or casters 14 may be equipped with a suitable braking mechanism to prevent unwanted movement of the surgical lamp. A back-up power unit 18 sits atop the base 12 and is fastened thereto. The back-up power unit 18 includes batteries and appropriate electrical circuitry for converting the direct current output of the batteries to a power source that can operate the light bulbs 20, which is 12 volts AC in the preferred embodiment and further electrical circuitry for determining when the normal wall outlet power has failed or needs to be switched off and the emergency back-up power activated. The normal power supply is 120 volts AC operating at 60 Hertz, which is converted to 12 volts AC by a step down transformer. If desired, the electricity from the power supply can be easily rectified to provide a direct current power supply. The back-up power unit 18 further comprises electrical circuitry for continuously charging the batteries while the surgical lamp 10 is plugged into a wall outlet source of electricity.

The column or stand 22 is a vertically oriented tubular column that is fastened to the base 12 and to the backside of the back-up power unit 18, which does not extend through the full depth of the base 12. A horizontal arm 24 is attached to the column 22 by means of the swivel joint 26, which allows the arm 24 to be rotated 350° in a horizontal plane, pivoting about the column 22. The horizontal arm 24 further comprises a first horizontal arm portion 28, which is connected to the column 22, and a horizontal extension arm section 30. The two sections of the horizontal arm 28, 30 are joined by the swivel joint 32, which allows for rotation of the horizontal extension arm section 30 relative to the first horizontal arm section 28. The horizontal extension arm 30 is attached to the swivel joint 32 at the first end 34 and includes a second end 36, which carries the swivel joint 38. The swivel joint 38 is connected to the depending support ring 40, which penetrates the shroud 42 and is fastened at each end to the lighthead support bar 44 (See FIG. 1).

The lighthead can be pivoted about the axis formed by the support bar 44. As shown in FIG. 5, the lighthead 46 has been pivoted into a vertical plane to illustrate placement of the light bulbs 20. During use, the lighthead 46 would normally be pivoted so that the light bulbs 22 direct their illumination downward. The ventilation openings 48 in the lower portion of the shroud 42 have a diameter slightly greater than the diameter of the light bulbs 20, allowing air to enter into the shroud 42 for cooling purposes.

A handle 50 projects outwardly from the lower body 52 of the shroud 42, that is, the portion of the shroud that is on the bottom of the lighthead 46 when the light bulbs 20 project their light downward. The handle 50 allows the surgeon to move the lighthead 46 into any convenient working position through a manipulation of the various swivel joints 38, 32, 26 and 54. The joints 54 (FIG. 5) join the support ring 40 to the support bar 44.

Figure 6:
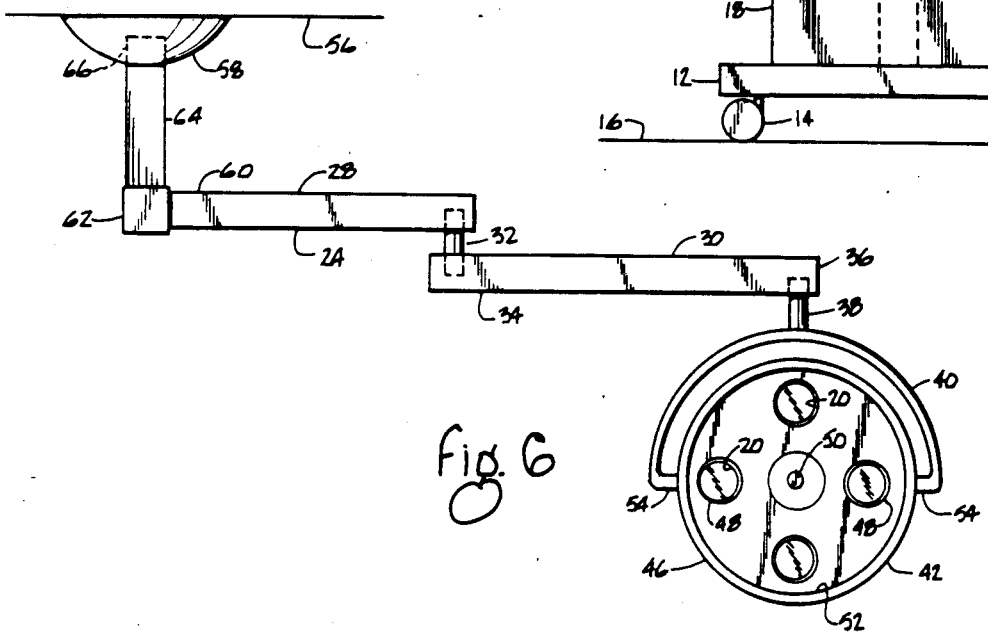
FIG. 6 is an alternative embodiment of the lamp designed for mounting on the ceiling.

Referring to FIG. 6, there is shown an alternative embodiment of the surgical lamp 10 designed for mounting on the ceiling 56 through means of the mounting dome 58, which is attached to the ceiling. Alternatively, the mounting dome 58 may be attached to a wall. In the embodiment illustrated in FIG. 6, a back-up power supply may be located at some remote distance from the surgical lamp 10, such as in a closet, and appropriate wiring may lead to the light bulbs 20. The surgical lamp 10 of FIG. 6 is mounted similarly to the surgical lamp of FIG. 5 and includes the same or similar mounting hardware, namely the horizontal arm 24 having a first horizontal arm section 28, a horizontal extension arm section 30 joined by the swivel joint 32, the swivel joint 38 joined to the horizontal extension arm section 30, and to the support ring 40, which is in turn joined to the support bar 44 at the joints 54. Also included is the coupling 62 attached to the end of the horizontal arm 24 nearest the mounting dome 58. The coupling 62 is also connected to the vertical drop arm 64.

Figure 1:
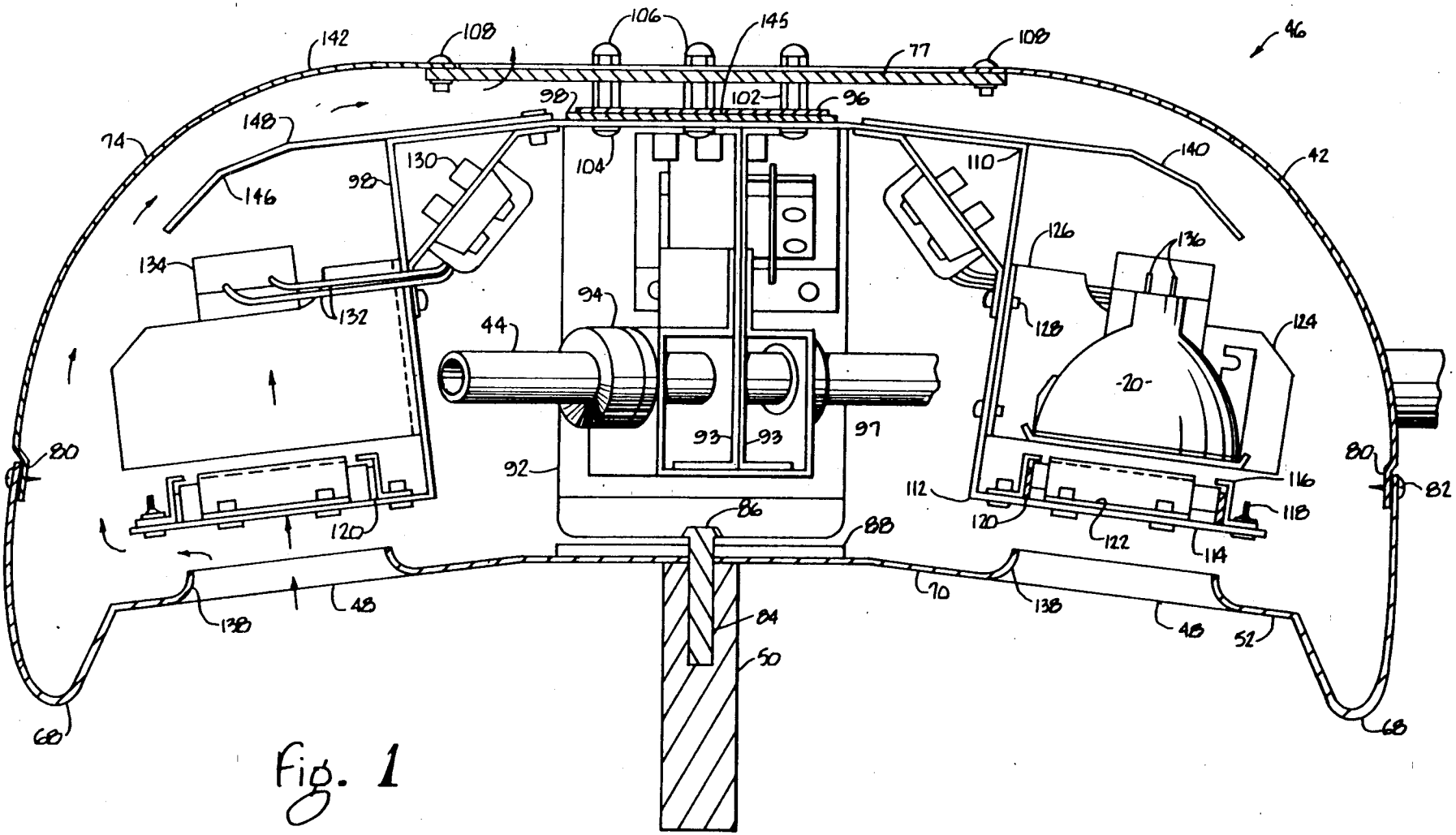
FIG. 1 is a cross sectional side elevation of the lighthead assembly of the present invention.
Figure 2:
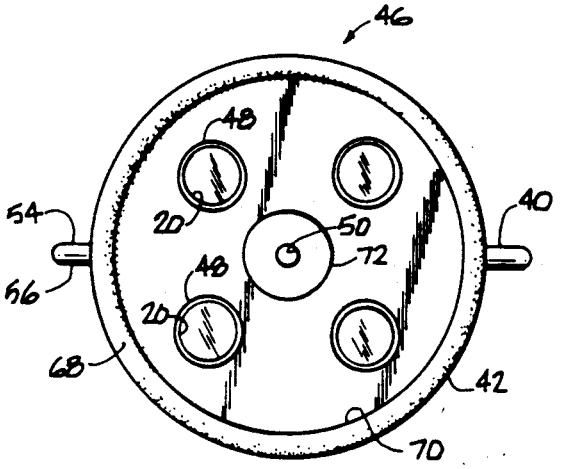
FIG. 2 is a bottom plan view of the lighthead, showing the lower body portion of the shroud.

Referring now to FIG. 2, there is shown a front plan view of the lighthead 46, pivoted relative to the support ring 40 so that the support ring 40 passes behind the shroud 42. The four light bulbs 20 are disposed in a square pattern, with one light bulb 20 in each corner, that is, the light bulbs 20 are spaced 90° apart and the light projecting ends of the glass envelopes or lenses, of the light bulbs 20 are essentially in the same plane. A lip 68 is formed about the circumference of the lower body portion 52 of the shroud 42 by a deep bend that creates a recessed portion 70 of circular shape, with the recessed portion 70 forming a substantially flat disk containing the ventilation openings 48. A slight detent ring 72 strengthens the lower body 52 of the shroud 42 to reduce the likelihood of bending or other deformation when the handle 50 is manipulated by the surgeon. The support ring 40 penetrates the apertures 56 in the upper body portion 74 of the shroud 52 (see FIG. 1).

More specifically, the recessed portion 70 slopes downward from the horizontal and radially outward of the center of the lower body portion 52 of the shroud 42, that is, the point where the handle 50 is attached. This downward slope is 7° and is uniform throughout the bottom section of the lower body portion 52 from the outer perimeter of the circular recessed portion 70, which is flat, to the inside edge of the lip 68. The four brackets 98 for retaining the light bulbs 20 and the glass hold-down brackets 116 (disclosed in detail below) are also aligned at a downward slope of 7° from the horizontal in such a manner that the light beams from the four light bulbs 20 tend to converge at a point directly below the handle 50.

This arrangement of the parts ensures that the light beams from the light bulbs 20 will pass through the openings 48 perpendicular to them, thus reducing the amount of light lost to scattering inside the shroud 42.

Figure 3:
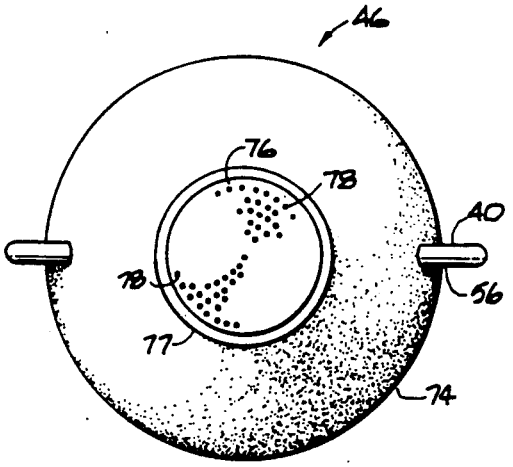
FIG. 3 is a top plan view of the lighthead showing the upper body portion of the shroud.

More importantly, this arrangement of the light bulbs 20 and associated parts produces a pattern of overlapping circles of light that provides the high intensity shadow-free lighting that is required for surgery. In particular at the universally recommended distance of 42 inches (107 cm) between the lower plane of the lighthead 46 and the patient, the light bulbs 20 project onto a surface perpendicular to the general plane of the bottom of the lighthead 42 a circular pattern of light having a zone 13 inches (33.02 cm) in diameter whose light intensity at the perimeter of this circle is at least 20 percent as intense as the light at the center of the circle by any standard measure of light intensity. To achieve this result, light bulbs having a projected light beam pattern of 12° were selected. In addition, the four light bulbs 20 are 8.75 inches (22.225 cm) apart on centers from corner-to-corner around the perimeter of the square pattern they form and have a plan view lens diameter of about 2 inches (5.08 cm). The preferred embodiment light bulbs also include self-contained dichroic reflectors. The three factors of bulb spacing and pattern, bulb beam width, and the angle at which the light beams are projected ensure ideal surgery lighting when the lights are 42 inches (107 cm) from their target and ensure adequate lighting when the light bulbs 20 are from about 36 inches to about 48 inches (91.5 cm–123 cm) from the target. Other light patterns on the surgery table could, of course, be created by changing the spacing between the bulbs 20, the angle of which they are aimed, and the beam width of the bulbs. Referring to FIG. 3, there is shown a rear plan view of the lighthead 46. In this view, the lighthead 46 is pivoted so that the support ring 40 does not cross the entire figure, which would obscure it. The upper body portion 74 includes a central aperture 76 for ventilation. A ventilation screen 77 is retained inside the volume enclosed by the shroud 42 by fasteners described below and includes a large number of ventilation openings, which may be circular, within the portion of the area of the ventilation screen 77 that lies within the central aperture 76. The large number of ventilation openings 78 allow hot air to escape upwardly when the surgical light 10 is in use, with the cooling air coming through the openings 48 in the lower body 52 of the shroud 42. As will be discussed below, certain internal components promote the flow of cooling air around the light bulbs 20 and through the shroud 42.

Referring to FIG. 1, there is shown a sectional view of the lighthead 46 enclosed by the shroud 74 having the lower body portion 52 and the upper body portion 74 which are separate pieces having a lap seam 80 formed about the circumference of the upper body portion 74 into which the upper edge of the lower body portion 52 of the shroud 42 is seated. The two sections of the shroud are held together by the sheet metal screws 82 or rivets. Both sections of the shroud 42 are preferably made from spun aluminum. The shroud 42 does not bear any significant weight load and may be lightweight and thin. The shroud includes means for induced convection ventilation and cooling of the lighthead which comprises the ventilation openings 48 in the lower body portion 52 and the central aperture 76 in the upper body portion 74 of the shroud 42.

Still referring to FIG. 1, the handle 50 may be press fitted onto a retaining stud 84 having a head 86 that is fitted through a load distributing washer 88 and an aperture 90 in the center of the lower body portion 52 of the shroud 42. The diameter of the load distributing washer 88 is conveniently the same as the diameter of the detent ring 72 (see FIG. 2), which will prevent any damage to the lower body portion 52 when the surgeon moves the lighthead 46. The retaining stud 84 may be replaced by a bolt, which may be threaded onto the handle 50.

Still referring to FIG. 1, the frame or chassis 92 comprises the load bearing structure that carries the weight of all other components of the lighthead 46. The chassis 92 includes a plurality of box-like frame members 93 fastened together by rivets, spot welding, or other means and includes a plurality of aligned central apertures 97 through which the support bar 44 is retained in the bushings 94, which allow rotation of the support bar 44 along its axis when fixed to the support ring 40 by adjustable sleeves that connect the two parts. The support bar 44 and the chassis 92 can rotate relative to one another about the longitudinal axis of the support bar 44 because the collars 94 keep the support bar 44 in its proper position within the chassis 92, i.e., it cannot move back and forth, while allowing the support bar 44 to rotate. A spring (not shown) urges the collars 94 against the chassis 92, leading to frictional engagement sufficient to maintain the lighthead 46 in the rotational position set by the surgeon.

The brackets 98 for holding the light bulbs 20 include a straight horizontal portion that passes over the top of the chassis 92. There are two bracket assemblies 98 holding two bulbs each—one on each end. The two brackets 98 are perpendicular to each other in plan view, matching the cross pattern of the baffles 140 in FIG. 4 since the brackets 98 lie under the baffles 140.

Figure 4:
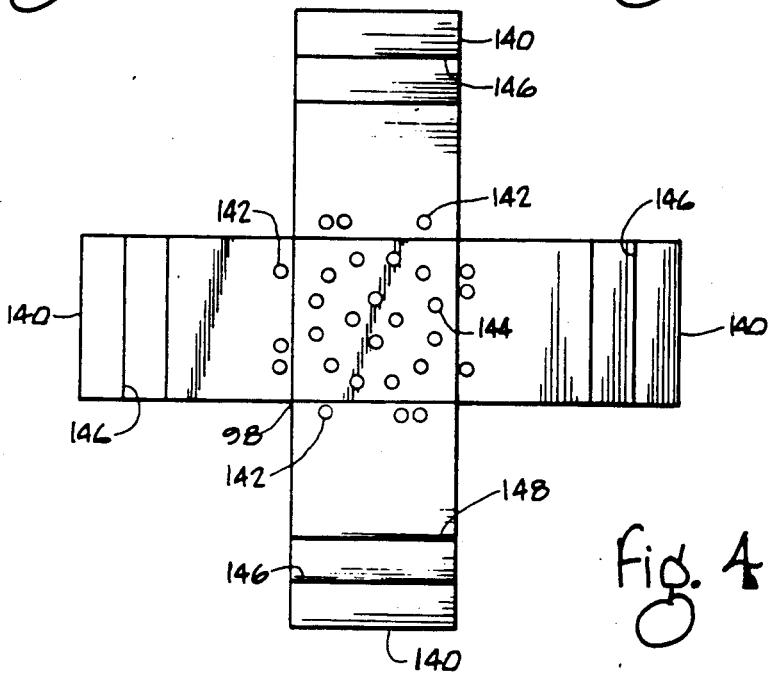
FIG. 4 is a top plan view of the arrangement of the baffles within the lighthead.

Referring to FIG. 4, there is shown a top plan view of the baffles 140, which form a cross shaped pattern with the four arms distributed 90° apart from each other. The four baffles are made from different sections of sheet metal and are fastened to the bracket 98 by the rivets 142. A pattern of apertures 144 allows the various fasteners, such as bolts 104 to be inserted readily during assembly. Each baffle 40 includes a first downward fold 146 and a second downward fold 148 which allow the baffle 140 to follow, more or less, the curvature of the upper body portion 74 of the shroud 42, thereby forming the chimney 142. In an alternative embodiment, each baffle 140 may be bent in a curve that matches the curvature of the shroud 42.

The three collar-spacers 102 maintain a space between the chassis 92 and the ventilation screen 77. All these elements are held together by the screws 104 and cap nuts 106. The upper body portion 74 of the shroud 52 is fastened to the ventilation screen 77 by the rivets or screws 108.

Still referring to FIG. 1 each bracket 98 includes a downward right angle bend 110 and a second right angle bend 112, resulting in a substantial horizontal portion 114, which carries the glass hold-down bracket 116. The glass hold-down bracket 116 comprises two metal flanges secured by the rivets or screws 118 and high temperature silicon cushion blocks 120 which retain the glass color correcting filters 122 which is preferably made from a heat absorbing material that absorbs infrared light, corrects the color to natural sunlight, that is, a color temperature of at least 3,500° K., and serves as a protective screen over the light bulb, or lamp 20. The lamp 20 is preferably a quartz-halogen lamp having a natural color temperature of about 3,000° K. and as such may be susceptible to breakage during operation without any impact. Accordingly, it is important that a screen cover the lamp 20. Such a color correcting heat absorbing material is glass impregnated with iron phosphate and cobalt. To correct the light output of a typical standard quartz-halogen lamp to a color approaching the color of natural sunlight requires that the longer wavelengths of light be absorbed disproportionately to the shorter wavelengths. In the process about half of the light output from the quartz-halogen lamps is absorbed by the filters 122 and must be dissipated as heat. At the same time, the quartz-halogen lamps 20 will burn out prematurely if overheated. Thus, a good heat dissipation mechanism is required.

The light bulb brackets 124 include a flange 126 that is bolted to the bracket 98 by fasteners 128. Two-wire connectors 130 are fastened to the leads 132, which in turn connect to a lamp-pin connector 134, which is fastened to the lamp contact pins 136.

The ventilation openings 48 in the lower body 52 of the shroud 42 include the rounded up-turned lips 138, which promote the flow of ventilating air through the lighthead 46.

In operation, when the light bulbs 20 are turned on about 30 percent of their light output is absorbed by the glass color correcting filters 122 and an additional 20 percent is lost through the back of the dichroic reflectors of the bulbs. The baffles 140 convert the heat from the reflectors from radiant heat to convective heat. Convection causes the air warmed by the lamps to rise, where it encounters the baffles 140, which are bolted to the brackets 98 near the chassis 92. The warm air flow is then directed to the chimney 142 formed in the space between the baffles 140 and the upper body portion 74 of the shroud 42. The warmed air flows through this passage way until it exits the shroud 42 through the ventilating holes 78 in the ventilation screen 77. The air leaving the shroud 42 must naturally be replaced by incoming air, which is drawn in through the ventilation openings 48 in the lower body portion 52 of the shroud 42.

The power lines into the lamp are conveniently threaded through the stand 22, the horizontal arm 28, the swivel joint 38, and the support ring 40, from which they emerge and are routed to the four light bulbs 22.

It is to be understood that while certain forms of this invention have been illustrated and described, it is not limited thereto, except and insofar as such limitations are included in the following claims.

What is claimed and desired to be secured by Letters Patent is as follows:

1. A lamp comprising:

(a) a base;

(b) a stand attached to said base;

(c) a lighthead, including a plurality of individual light bulbs;

(d) means for conducting electricity to said light bulbs;

(e) means for adjustably attaching said lighthead to said stand;

(f) means for cooling said lighthead, including a plurality of openings through a top of said lighthead and an array of baffles providing air passgeways for entry of ambient air from below said lighthead, flow through said passageways and exit through said openings; and (g) a support bar for attaching said lighthead to said stand and for supporting said lighthead, said support bar attached to a frame, a plurality of baffles attached to said frame and extending outwardly therefrom and each said baffle positioned above a bracket for retaining a light bulb fixed to said frame.

2. A lamp as claimed in claim 1 wherein said lighthead further comprises a support bar for attaching said lighthead to said stand and for supporting said lighthead, said support bar attached to a frame, a plurality of baffles attached to said frame and extending outwardly therefrom and each said baffle positioned above a bracket for retaining a light bulb fixed to said frame.

3. A lamp as claimed in claim 2 wherein said plurality of baffles further comprises four baffles disposed in a pattern having the shape of a cross with perpendicular arms and a plurality of holes distributed in and around a central portion of said cross pattern.

4. A lamp as claimed in claim 3 wherein each said baffles further comprises an outer flange portion disposed at a downward angle relative to the remaining portions of said baffles whereby rising air heated by said lamps is deflected to flow around said baffles.

5. A lamp as claimed in claim 3 wherein each said baffle further comprises an intermediate portion between said outer portion and said central portion of said cross pattern, said intermediate portion being disposed at a downward angle relative to said central portion of said cross pattern, whereby air heated by said lamps is deflected to flow about said baffles.

6. A lamp as claimed in claim 2 wherein said lighthead further comprises a shroud having an upper body portion and a lower body portion, fastened together, attached to and enclosing said frame, said baffles, said brackets and said light bulbs.

7. A lamp as claimed in claim 6 wherein said shroud further comprises a means for induced convection ventilation of said shroud.

8. A lamp as claimed in claim 6 wherein said upper body portion shroud further comprises a central portion having a plurality of holes therethrough for ventilating hot air heated by said light bulbs.

9. A lamp as claimed in claim 8 wherein said central portion of said upper body portion of shroud further comprises a central opening and a ventilation plate having a plurality of holes therethrough secured to said upper body shroud and covering said central opening.

10. A lamp as claimed in claim 6 wherein said baffles and said shroud define at least one chimney for the transport of hot air.

11. A lamp as claimed in claim 6 wherein lower body portion of shroud further comprises a plurality of ventilation openings, one said opening for each of said light bulbs, each said opening having a diameter slightly larger than the diameter of said light bulb.

12. A lamp as claimed in claim 9 wherein said ventilation opening further comprises a smooth circular lip turned upward and flowing into said lighthead to facilitate the flow of air into said lighthead.

13. A lighthead for a lamp, comprising:

(a) a chassis;

(b) a support bar fastened to said chassis and extending beyond said chassis for mounting said lighthead on a stand;

(c) a plurality of brackets for retaining a plurality of light bulbs, said brackets fixed to said chassis and with one said bracket each positioned below a baffle; and (d) a plurality of light bulbs, one said light bulb disposed in each said light retaining bracket; and (e) means for inducing convective ventilation and cooling of said lighthead, wherein ambient air enters the lighthead from underneath, passes through said cooling means further comprising at least one chimney formed by a shroud housing said chassis and said light bulbs, and at least one baffle enclosed within said shroud and openings at a top of said lighthead, whereby said air escapes to ambient through said openings in said shroud.

14. A lighthead as claimed in claim 13 wherein said baffle further comprises a plurality of baffles attached to said chassis and extending outwardly therefrom with one said baffle disposed over each said light bulb, and forming at least one passageway between each said baffle and said shroud whereby air heated by the light bulbs rises to and passes about said baffles with at least a portion of said hot air being channeled into at least one said passageway.

15. A lighthead for a lamp as claimed in claim 13 further comprising a plurality of quartz-halogen light bulbs.

16. A lighthead for a lamp as claimed in claim 13 further comprising one glass hold-down bracket disposed below each said bracket and a light filter in each said glass hold-down bracket.

17. A lighthead for a lamp as claimed in claim 13 further comprising a shroud having an upper body and a lower body fastened together, and attached to and enclosing said chassis, said baffles, and said brackets, said upper shroud body including means for ventilating hot air generated by said light bulbs, said lower shroud body including a plurality of openings, one said opening for each said light bulb, each said opening having a diameter slightly larger than the diameter of each said light bulb.

18. A lighthead for a lamp, comprising:

(a) a chassis;

(b) a support bar fastened to said chassis and extending beyond said chassis for mounting said lighthead on a stand;

(c) a plurality of baffles attached to the top of said chassis and extending outwardly therefrom in a substantially horizontal plane when said lighthead is oriented for downward projection of light;

(d) a plurality of brackets for retaining a plurality of light bulbs, said brackets fixed to said chassis and with one said bracket positioned below each said baffle;

(e) a plurality of quartz-halogen light bulbs, one light bulb disposed in each said light retaining bracket;

(f) one glass hold-down bracket disposed below each said bracket and a light filter in each said glass hold-down bracket; and (g) a shroud having an upper body and a lower body fastened together, and attached to and enclosing said chassis, said baffles, and said brackets, said upper shroud body including openings allowing escape of hot air generated by said light bulbs, said lower shroud body including a plurality of openings, one said opening for each said light bulb, each said opening having a diameter slightly larger than a diameter of each said light bulb.

19. A lighthead for a lamp comprising:

(a) a chassis;

(b) a plurality of brackets attached to said chassis for retaining a plurality of light bulbs;

(c) one light bulb mounted in each said bracket with said brackets being positioned and aligned with respect to one another such that the light from each said bulb overlaps to create a circular pattern of light about 13 inches (33 cm) in diameter wherein the light at the outer perimeter of said circular pattern is at least 20 percent as intense as the light at the center of said circular pattern when the light bulbs are about 42 inches (107 cm) from a target;

(d) a plurality of baffles, with one said baffle attached to each said bracket over each said light bulb;

(e) a shroud enclosing said chassis, said brackets, said baffles and said light bulbs, said shroud including an upper body portion and said lower body portion both having means for ventilating hot air generated by said light bulbs, said ventilating means further comprising a chimney between said upper body portion of said shroud and each said baffle, said lower shroud body including a plurality of openings, one said opening for each said light bulb; each said opening having a diameter larger than the diameter of each said light bulb; and (f) means for supplying electricity to said light bulbs.

20. A lighthead for a lamp comprising:

(a) a chassis;

(b) four brackets fixed to said chassis for retaining four light bulbs with one said light bulb in each said bracket, said brackets disposed to form a square pattern in bottom plan view with one said bracket at each corner of said square pattern, said brackets angled downward from the horizontal such that said light bulbs project beams of light downward from the horizontal such that said beams of light are projected toward a point below the center of said square pattern;

(c) four baffles with one said baffle attached to each said bracket over each said light bulb;

(d) a shroud attached to said chassis and enclosing said chassis, said brackets, said baffles and said light bulbs, said shroud including an upper body portion and a lower body portion both having means for ventilating hot air generated by said light bulbs, said ventilating means further comprising a chimney between said upper body portion of said shroud and each said baffle, said lower shroud body including a plurality of openings, one said opening for each said light bulb, each said opening having an area larger than the diameter of each said light bulb; and (e) means for supplying electricity to said light bulbs.

21. A lighthead for a lamp as claimed in claim 20 wherein said downward angle is 7°.

22. A lighthead for a lamp as claimed in claim 20 wherein said square pattern is 8.75 inches (22.225 cm) from corner-to-corner along the perimeter of said square pattern.

23. A lighthead for a lamp as claimed in claim 20 wherein each said light bulb is a quartz-halogen light bulb having a self-contained dichroic reflector and a projected light beam pattern of 12°.

24. A lamp comprising:

(a) a base;

(b) a stand attached to said base;

(c) a lighthead, including a plurality of individual light bulbs;

(d) means for conducting electricity to said light bulbs;

(e) means for cooling said lighthead, including a plurality of openings through a top of said lighthead, an array of baffles providing air passageways for entry of ambient air from below said lighthead, flow through said passageways and exit through said openings, and a chimney means formed between a shroud enclosing said lighthead and a plurality of baffles within said shroud; and (f) at least one glass hold-down bracket disposed below said light bulb, and one light filter in said glass hold-down bracket.

* * * * *